US012256793B2

(12) United States Patent
Schultz et al.

(10) Patent No.: US 12,256,793 B2
(45) Date of Patent: Mar. 25, 2025

(54) ADJUSTABLE HOSPITAL GOWN

(71) Applicants: Robert Schultz, Boonton, NJ (US); Jonathan Schultz, Cedar Grove, NJ (US)

(72) Inventors: Robert Schultz, Boonton, NJ (US); Jonathan Schultz, Cedar Grove, NJ (US)

( * ) Notice: Subject to any disclaimer, the term of this patent is extended or adjusted under 35 U.S.C. 154(b) by 63 days.

(21) Appl. No.: 17/477,264

(22) Filed: Sep. 16, 2021

(65) Prior Publication Data

US 2022/0000198 A1 Jan. 6, 2022

Related U.S. Application Data

(63) Continuation-in-part of application No. 16/361,189, filed on Mar. 21, 2019, now abandoned.

(60) Provisional application No. 62/646,225, filed on Mar. 21, 2018.

(51) Int. Cl.
*A41D 13/12* (2006.01)

(52) U.S. Cl.
CPC ..... *A41D 13/1236* (2013.01); *A41D 2200/10* (2013.01); *A41D 2300/32* (2013.01); *A41D 2300/326* (2013.01); *A41D 2300/50* (2013.01)

(58) Field of Classification Search
CPC .. A41D 13/00; A41D 13/1236; A41D 13/129; A41D 13/12; A41D 13/1209; A41D 13/1218; A41D 13/1227; A41D 13/1245; A41D 13/1263; A41D 13/1281; A41D 2200/10; A41D 2300/30; A41D 2300/33; A41D 2400/44; A41D 2400/52; A41D 27/20
USPC ..... 2/114, 247, 48, 128, 311, 312, 338, 52
See application file for complete search history.

(56) References Cited

U.S. PATENT DOCUMENTS 2,720,655 A * 10/1955 Simon ..... A41D 15/00 2/115
3,935,596 A * 2/1976 Allen, Jr. ..... A41D 13/1209 2/114
4,524,463 A * 6/1985 Ogden ..... A41D 1/00 2/76
8,990,966 B2 * 3/2015 Von Furstenberg ..... A41D 13/1236 2/114
2005/0132465 A1 * 6/2005 Kathumbi-Jackson ..... A41D 13/1209 2/114
2012/0216374 A1 * 8/2012 Manuello ..... A41F 1/002 24/303
2015/0374048 A1 * 12/2015 Theodossiou ..... A41D 13/1245 2/114

(Continued)

*Primary Examiner* — F Griffin Hall

(57) ABSTRACT

An adjustable hospital gown is designed to cover the bodies of users of varying shape and size. The gown has a torso-covering garment, a pair of backflaps, and an adjustable fastener. The torso-covering garment is used to cover the front side of the user's body. The pair of backflaps are connected along backflap seams that are positioned on opposite sides of the torso-covering garment. As a result, the pair of backflaps can be transitioned between an opened and a closed configuration. The adjustable fastener is connected in between one of the backflaps and the torso-covering garment such that the backflap can be repositioned to cinch the gown around the body of the user. By connecting the adjustable fastener to various anchor points, the size of the gown can be modified to accommodate user's of varying shape.

2 Claims, 7 Drawing Sheets

(56) References Cited

U.S. PATENT DOCUMENTS

2016/0286872 A1* 10/2016 Wilson ..... A41D 13/0058

* cited by examiner

ADJUSTABLE HOSPITAL GOWN

The current application is a continuation application of a U.S. non-provisional application Ser. No. 16/361,189 filed on Mar. 21, 2019. The U.S. non-provisional application Ser. No. 16/361,189 claims a priority to a U.S. provisional application Ser. No. 62/646,225 filed on Mar. 21, 2018.

FIELD OF THE INVENTION

The present invention relates generally to an apparatus for a hospital gown. More specifically, the present invention is an apparatus for a hospital gown that is fully adjustable to accommodate users of varying shape and size.

BACKGROUND OF THE INVENTION

Hospital gowns are designed to efficiently cover a user's body while using the least amount of fabric as possible. This becomes a challenge because patients come in varying shape and size. To address this challenge, the present invention provides a hospital gown whose size can be adjusted as desired. Specifically, the present invention is a fully adjustable hospital gown with snaps built in at neck and waist to allow optimal usability for patient and ease of entry for a care provider. The waist of the gown can be cinched around the user's body by employing an adjustable fastener or belt. Similarly, the neck of the gown is designed to use multiple snap points that enable the size of the collar to be adjusted and accommodate users of varying size.

DETAIL DESCRIPTIONS OF THE INVENTION

Figure 1:
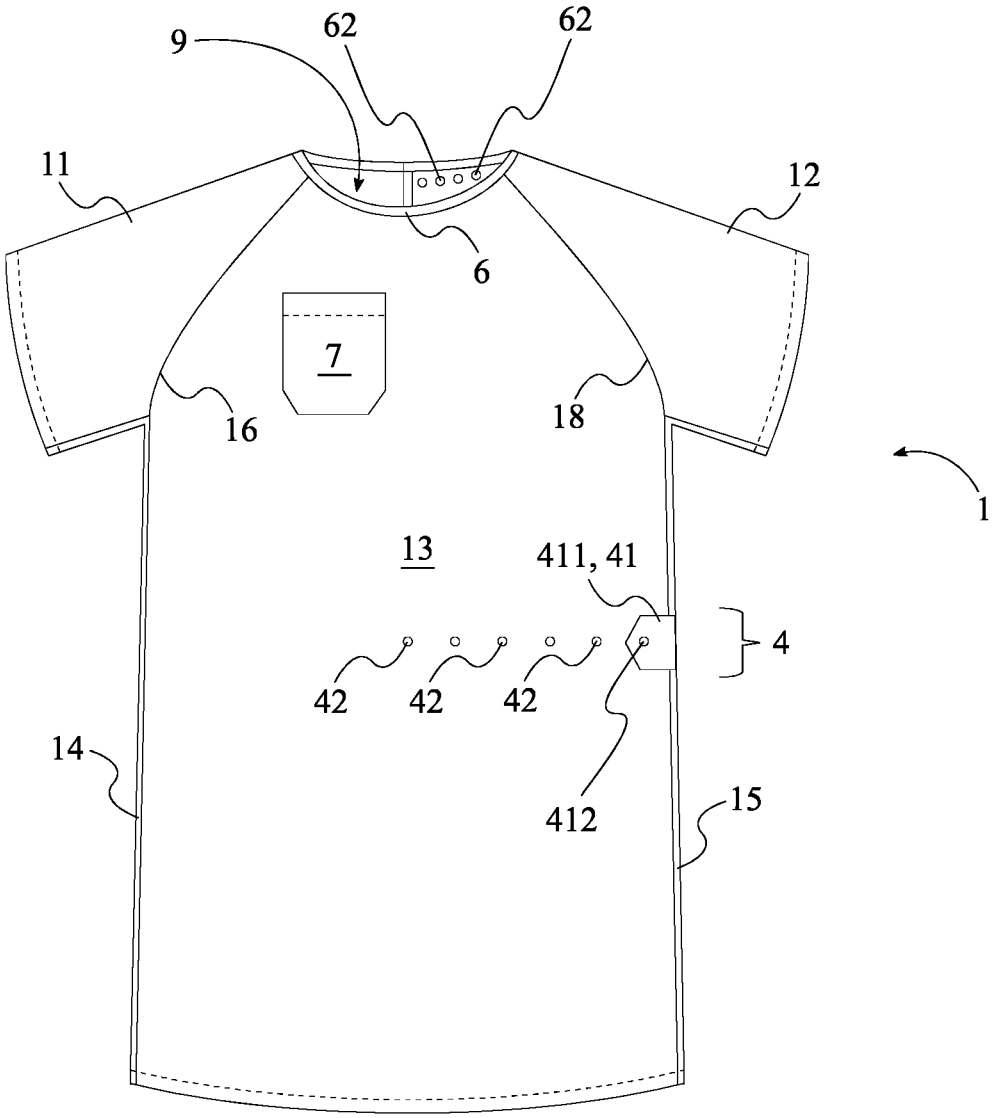
FIG. 1 is a front view of the present invention in a closed configuration.

All illustrations of the drawings are for the purpose of describing selected versions of the present invention and are not intended to limit the scope of the present invention.

Referring to FIG. 1 through FIG. 7, the present invention, the adjustable hospital gown, is a garment uses adjustable panels to provide coverage for users of varying shape and size. In addition to being adjustable, the present invention makes use of integrated fasteners that enable the gown to be quickly placed onto, or removed from, a user's body. The present invention comprises a torso-covering garment 1, a first backflap 2, a second backflap 3, and at least one adjustable fastening mechanism 4. The torso-covering garment 1 is the portion of the gown that is used to cover a front side of the user's body. Additionally, the first backflap 2 is adjacently connected along a first backflap seam 14 of the torso-covering garment 1. Similarly, the second backflap 3 is adjacently connected along a second backflap seam 15 of the torso-covering garment 1, opposite to the first backflap 2. As a result, the first backflap 2, the second backflap 3, and the torso-covering garment 1 form a gown that obscures the front side of the user's body while allowing easy access to the user's back side. This enables the present invention to be quickly removed or repositioned as desired.

Figure 2:
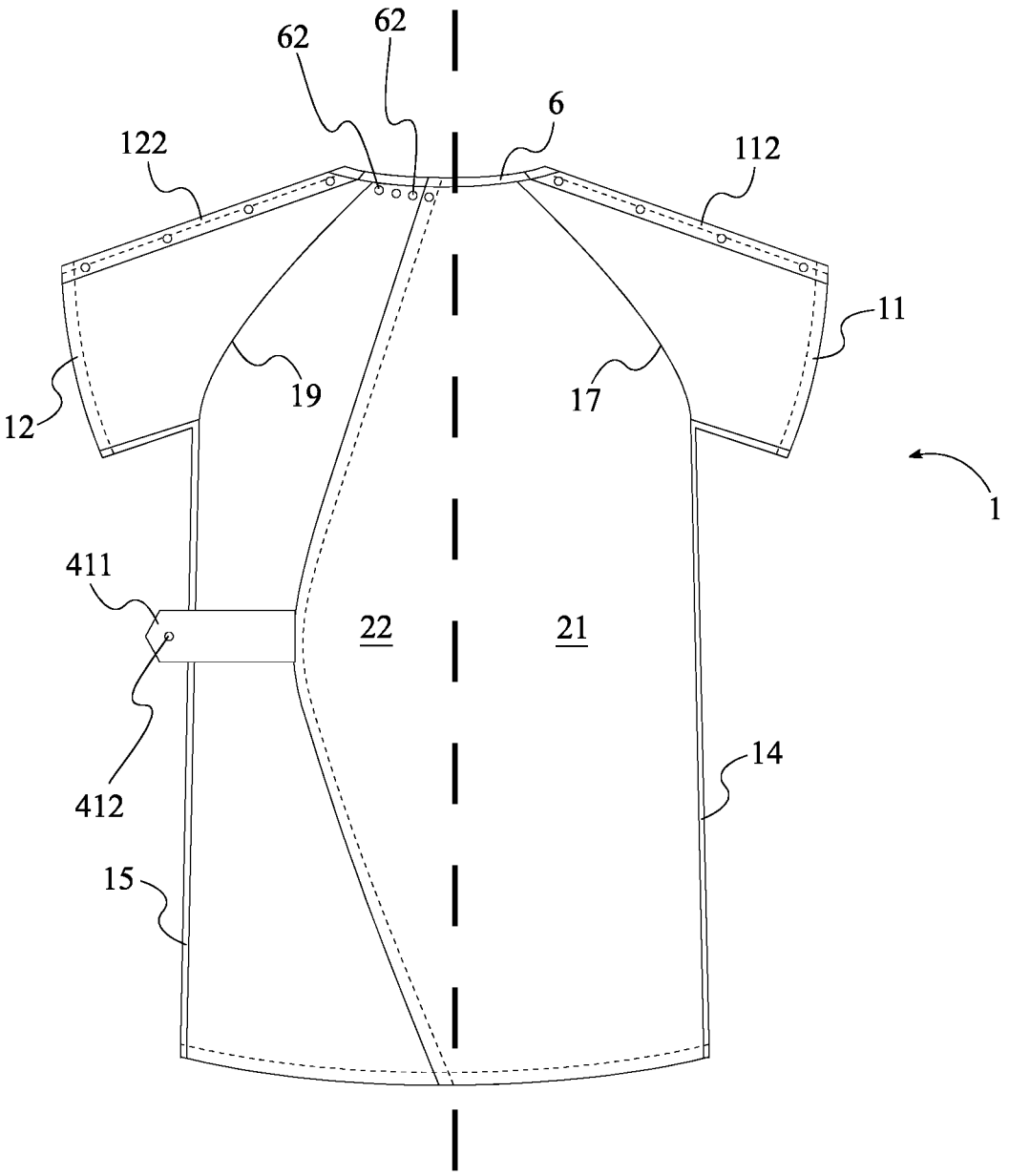
FIG. 2 is rear view of the present invention in the closed configuration.
Figure 3:
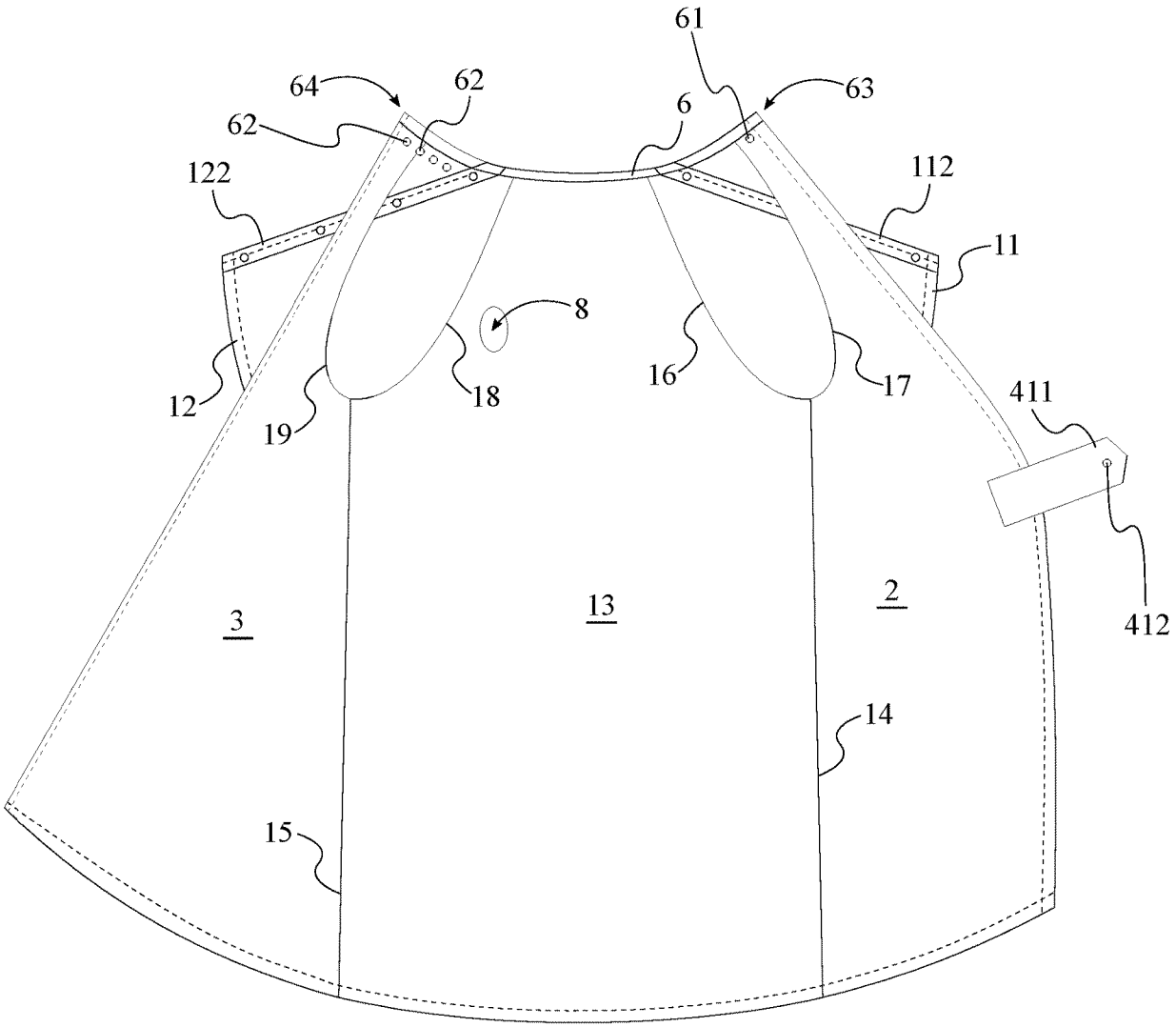
FIG. 3 is rear view of the present invention in an opened configuration.

Referring to FIG. 1 through FIG. 3, the adjustable fastening mechanism 4 is a fastening system that enables the first backflap 2 to be cinched around the user's body. To facilitate this, the adjustable fastening mechanism 4 comprises a connector assembly 41 and at least one anchor point 42. The connector assembly 41 and the anchor point 42 are interlocking members that can be quickly coupled or decoupled by the user. The connector assembly 41 is mounted onto the first backflap 2, opposite to the first torso-covering garment 1. Additionally, the anchor point 42 is mounted onto the torso-covering garment 1 and is positioned adjacent to the second backflap 3. Further, the connector assembly 41 is detachably coupled to the anchor point 42. Accordingly, the connector assembly 41 is used to mate the first backflap 2 to the anchor point 42 and seal the backside of the gown. When the connector assembly 41 is coupled to the anchor point 42 the present invention is in a closed configuration. In this configuration, the first backflap 2 is overlaid onto the second backflap 3 and a body cavity 5 is delineated by the torso-covering garment 1, the first backflap 2, and the second backflap 3. The body cavity 5 forms the space that is occupied by the user's body while wearing the present invention. In a closed configuration the connector assembly 41 is decoupled from the anchor point 42. Additionally, the first backflap 2 and the second backflap 3 are splayed such that access to the user's backside is permitted.

Figure 4:
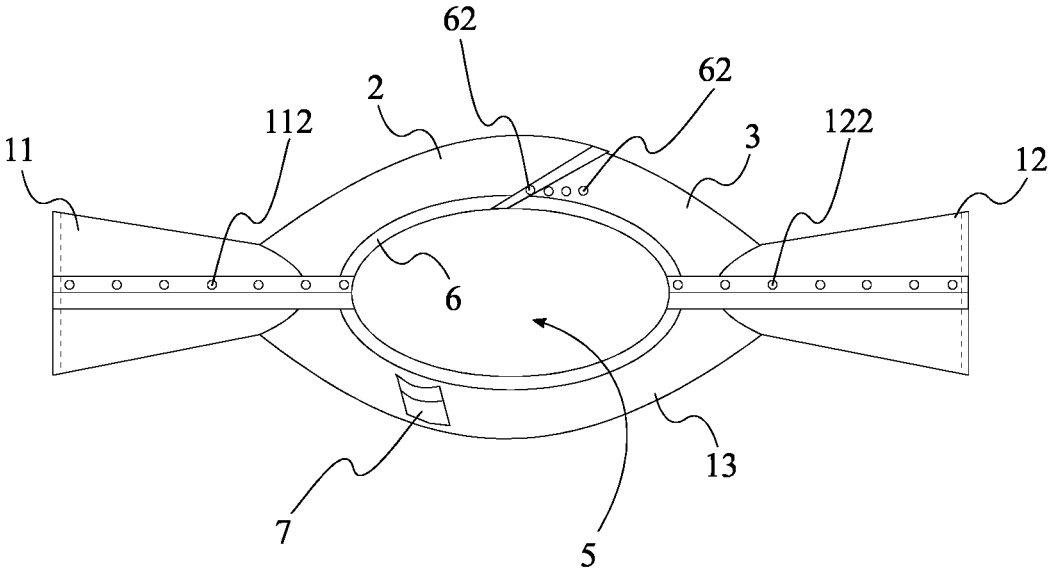
FIG. 4 is a top view of the present invention.
Figure 5:
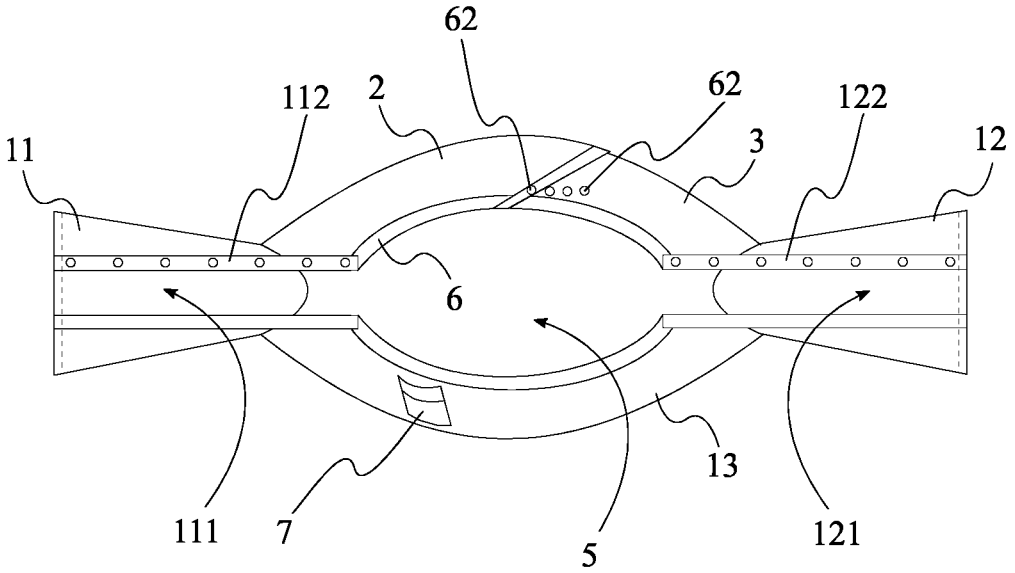
FIG. 5 is a top view of the present invention with the first adjustable slit and the second adjustable slit closed.
Figure 6:
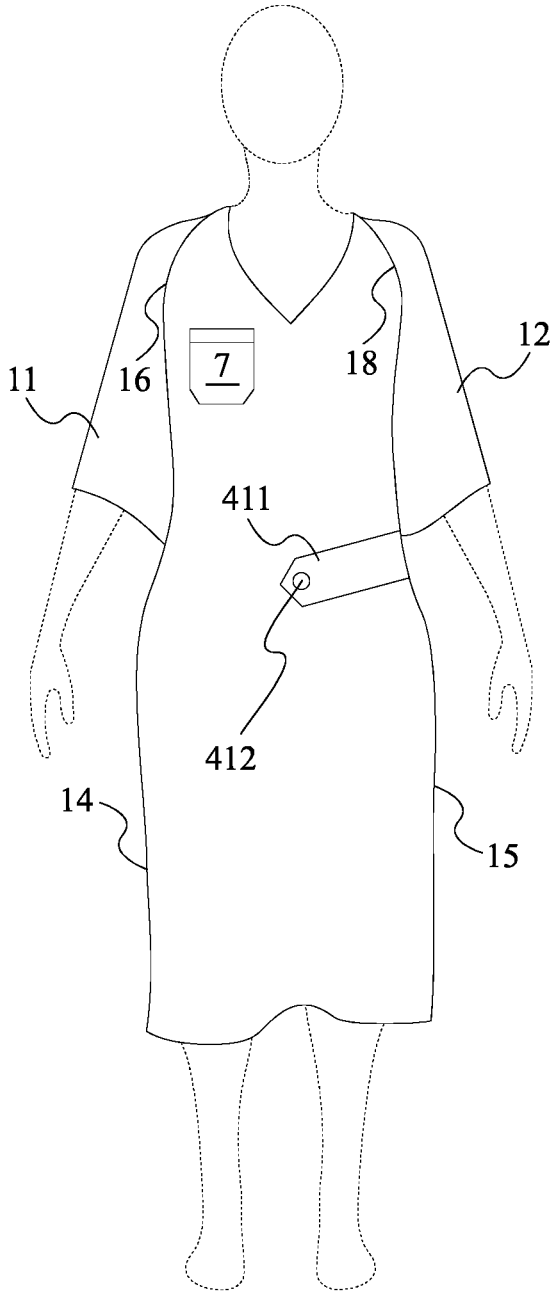
FIG. 6 is a front view of the present invention that adapted to fit a slender individual.
Figure 7:
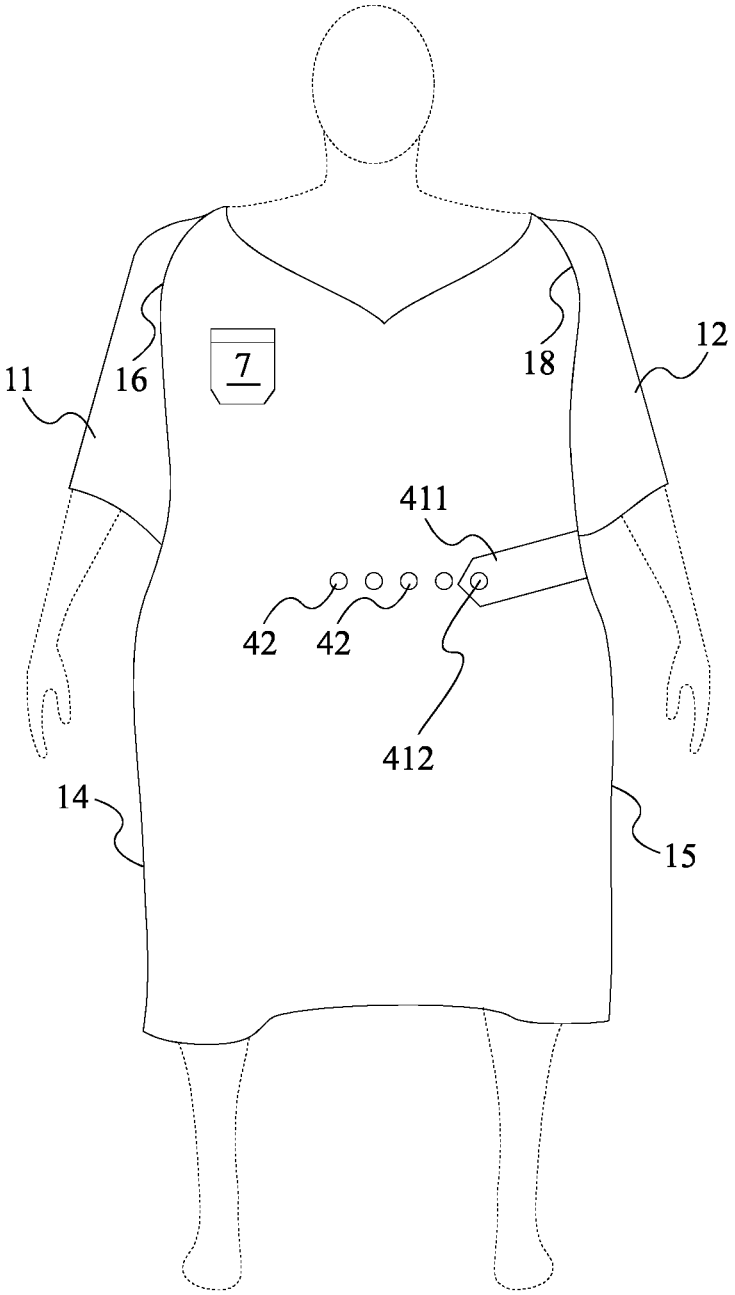
FIG. 7 is a front view of the present invention that adapted to fit a rotund individual.

Referring to FIG. 1, FIG. 2, and FIG. 4, as described above, the adjustable fastening mechanism 4 enables the present invention to be resized to accommodate users of varying body type. To achieve this functionality, the connector assembly 41 comprises a belt 411 and a non-adhesive mechanical fastener 412. Preferably, the at least one anchor point 42 is a plurality of anchor points 42. This enables the user to attach the non-adhesive mechanical fastener 412 to the anchor point 42 that cinches the gown appropriately. The belt 411 is terminally connected to the first backflap 2 so that the user may manipulate the adjustable fastening mechanism 4. The non-adhesive mechanical fastener 412 is integrated into the belt 411 and is positioned offset from the first backflap 2, across the belt 411. Thus positioned, the belt 411 and non-adhesive mechanical fastener 412 form an ergonomic handle that facilitates adjusting the size of the present invention to accommodate various body types. Expounding on this functionality, the plurality of anchor points 42 is serially distributed across the torso-covering garment 1. Accordingly, the user is able to increase or decrease the size of the body cavity 5 by coupling the non-adhesive mechanical fastener 412 to the appropriate anchor point 42 from the plurality or anchor points 42. Preferably, the non-adhesive mechanical fastener 412 and the plurality of anchor points 42 are snap fasteners. Embodiments of the present invention are designed to use fastener systems including, but not limited to, hook-and-loop connectors, magnetic couplers, clasps, and buttons.

Referring to FIG. 1 and FIG. 2, the present invention is designed to function as a gown that provides a maximum amount of coverage while using a minimal amount of material. To that end, the first backflap 2 comprises a covering portion 21 and an adjustment portion 22. While the present invention is in the closed configuration, the adjustment portion 22 is overlaid onto the second backflap 3. As such, the covering portion 21 is designed to be a connective webbing that is mated to the connector assembly 41. Additionally, the covering portion 21 is connected in between the torso-covering garment 1 and the adjustment portion 22. Thus positioned, the covering portion 21 is able to obscure the sections of the user's backside that are not obscured by the second backflap 3. Preferably the adjustment portion 22 is a triangular section of material with the connector assembly 41 positioned at the apex. And the covering portion 21 connected along the base.

Referring to FIG. 1 and FIG. 2, preferably the present invention is a gown with sleeves. To that end the torso-covering garment 1 comprises a central panel 13, a first sleeve 11 and a second sleeve 12. The central panel 13 hangs over the chest and abdomen. The first sleeve 11 is connected along a first front shoulder seam 16 of the central panel 13. Additionally, the first sleeve 11 is connected along a first rear shoulder seam 17 of the first backflap 2. Similarly, the second sleeve 12 is connected along a second front shoulder seam 18 of the central panel 13. Additionally, the second sleeve 12 is connected along a second rear shoulder seam 19 of the first backflap 2. As a result, the present invention forms a sleeved gown that will not fall off the user's body even while in the opened configuration.

Referring to FIG. 1 through FIG. 5, a supplemental embodiment is designed with sleeves that can be disassembled. To achieve this functionality the present invention further comprises a first adjustment slit 111, a second adjustment slit 121, a first slit fastener 112 and a second slit fastener 122. The first adjustment slit 111 traverses through the first sleeve 11. Additionally, the first adjustment slit 111 is oriented parallel to a longitudinal axis of the first sleeve 11. Further, the first slit fastener 112 is detachably connected across the first adjustment slit 111. As a result, the first sleeve 11 can be broken into two flaps that wrap around the user's first arm. This enables the first sleeve 11 to be placed onto the user's first arm via traditional methods or by snapping the two flaps around the user's limb. The second adjustment slit 121 traverses through the second sleeve 12. Additionally, the second adjustment slit 121 is oriented parallel to a longitudinal axis of the second sleeve 12. Further, the second slit fastener 122 is detachably connected across the second adjustment slit 121. As a result, the second sleeve 12 can be broken into two flaps that wrap around the user's second arm. This enables the second sleeve 12 to be placed onto the user's second arm via traditional methods or by snapping the two flaps around the user's limb.

Referring to FIG. 1 and FIG. 3, as described above, the present invention is designed to accommodate users of varying shape and size. To that end, the present invention further comprises an adjustable collar 6, a collar fastener 61, and at least one collar anchor point 62. The adjustable collar 6 is integrated around a neck hole 9 of the torso-covering garment 1. Additionally, the collar fastener 61 is connected adjacent to a first end 63 of the adjustable collar 6. Further, the at least one collar anchor point 62 is connected adjacent to a second end 64 of the adjustable collar 6, opposite to the collar fastener 61. As a result, the user is able to modify the size of the neck hole 9 by coupling the collar fastener 61 to a desired collar anchor point 62.

Referring to FIG. 1 through FIG. 7, the present invention further comprises a pocket 7 and an access hole 8. The pocket 7 is connected adjacent to the torso-covering garment 1 and is positioned opposite to the body cavity 5, across the torso-covering garment 1. Accordingly, the pocket 7 is mounted onto an exterior surface of the torso-covering garment 1 to facilitate storage and retrieval of equipment and personal items. The access hole 8 traverses through the torso-covering garment 1 into the pocket 7. As a result, tubes and cables can be passed from the pocket 7 into the body cavity 5, discretely.

Although the invention has been explained in relation to its preferred embodiment, it is to be understood that many other possible modifications and variations can be made without departing from the spirit and scope of the invention as hereinafter claimed.

What is claimed is:

1. An adjustable hospital gown to be worn by a subject comprising:

a torso-covering garment comprising a central panel configured to obscure the front side of the subject, a first sleeve, and a second sleeve;

a first backflap being adjacently connected along a first backflap seam of the torso-covering garment;

a second backflap being adjacently connected along a second backflap seam of the torso-covering garment, opposite to the first backflap;

a first adjustment slit;

at least one first slit fastener;

a second adjustment slit;

at least one second slit fastener;

an adjustable collar;

a collar fastener;

at least one collar anchor point;

at least one adjustable fastening mechanism comprising a belt, a first snap-fastener interlocking piece, and a plurality of second snap-fastener interlocking pieces;

the belt being terminally connected to the first backflap;

the first snap-fastener interlocking piece being integrated into the belt and being positioned offset from the first backflap;

wherein:

the belt is mounted onto the first backflap, opposite to the torso-covering garment;

the plurality of second snap-fastener interlocking pieces is serially distributed across the torso-covering garment, adjacent to the second backflap;

the first snap-fastener interlocking piece is detachably and selectively coupled to the plurality of second snap-fastener interlocking pieces; and the at least one adjustable fastening mechanism is arranged to enable the first backflap to be cinched around the subject's body in such a manner that, when in a closed configuration, the first backflap overlaps with the second backflap forming a covering portion and an adjustment portion on the backside of the subject, wherein the adjustment portion forms a triangular section with the first backflap and the belt, such that the first snap-fastener interlocking piece is at an apex of a triangle and the covering portion is at a base of the triangle, thereby allowing the gown to obscure the front of the subject while permitting easy access to the backside of the subject;

the first sleeve being connected along a first front shoulder seam of the central panel;

the first sleeve being connected along a first rear shoulder seam of the first backflap;

the second sleeve being connected along a second front shoulder seam of the central panel, opposite to the first sleeve;

the second sleeve being connected along a second rear shoulder seam of the second backflap;

the first adjustment slit traversing into the first sleeve;

the first adjustment slit being oriented parallel to a longitudinal axis of the first sleeve;

the first adjustment slit being positioned opposite to the first backflap seam about the first sleeve;

the first adjustment slit traversing through a distal arm opening of the first sleeve, along the first sleeve, and into a neck hole of the torso-covering garment;

the first slit fastener being detachably connected across the first adjustment slit;

the second adjustment slit traversing into the second sleeve;

the second adjustment slit being oriented parallel to a longitudinal axis of the second sleeve;

the second adjustment slit being positioned opposite to the second backflap seam about the second sleeve;

the second adjustment slit traversing through a distal arm opening of the second sleeve, along the second sleeve, and into a neck hole of the torso-covering garment;

the second slit fastener being detachably connected across the second adjustment slit;

the adjustable collar being integrated around the neck hole of the torso-covering garment;

the collar fastener being connected adjacent to a first end of the adjustable collar; and the at least one collar anchor point being connected adjacent to a second end of the adjustable collar, opposite to the collar fastener.

2. The adjustable hospital gown as claimed in claim 1 further comprising:

a pocket;

an access hole;

the pocket being connected adjacent to the torso-covering garment;

the pocket being positioned opposite to the body cavity, across the torso-covering garment; and the access hole traversing through the torso-covering garment into the pocket.

* * * * *